US005101579A

United States Patent [19]

Terlizzi et al.

[11] Patent Number: 5,101,579

[45] Date of Patent: Apr. 7, 1992

[54] SOUND DEADENING BALLET SHOE

[75] Inventors: Donald Terlizzi, Prompton Plains; Daniel Leva, Somerset, both of N.J.; Philip L. Rossi, Brooklyn, N.Y.

[73] Assignee: Ballet Makers Inc., Totowa, N.J.

[21] Appl. No.: 389,775

[22] Filed: Aug. 4, 1989

[51] Int. Cl.[5] ..... A43B 3/00; A43B 23/00

[52] U.S. Cl. ..... 36/83; 36/113

[58] Field of Search ..... 36/8.3, 113, 9 R, 77 R

[56] References Cited

U.S. PATENT DOCUMENTS

| | | | |
|---|---|---|---|
| 1,520,708 | 12/1924 | Goldstein et al. | 36/8.3 |
| 1,689,535 | 10/1928 | Rovick | 36/113 |
| 1,704,281 | 3/1929 | Capezio | 36/8.3 |
| 1,953,659 | 4/1934 | Savino | 36/113 |
| 2,110,890 | 3/1938 | Paul | 36/113 |
| 2,810,214 | 10/1957 | Wolfe | 36/8.3 |
| 4,026,046 | 5/1977 | Clark et al. | 36/113 |
| 4,199,878 | 4/1980 | Wossner | 36/113 |
| 4,412,393 | 11/1983 | Terlizzi, Jr. et al. | 36/77 R |

FOREIGN PATENT DOCUMENTS

| | | | |
|---|---|---|---|
| 30125 | 11/1931 | Australia | 36/8.3 |
| 509482 | 7/1929 | Fed. Rep. of Germany | 36/8.3 |

*Primary Examiner*—Steven N. Meyers

*Attorney, Agent, or Firm*—Ostrolenk, Faber, Gerb & Soffen

[57] ABSTRACT

A ballet dancer's shoe that reduces noise occurring when a ballet dancer bangs a toe portion of the shoe against the floor. The shoe comprises a shank and a shoe upper comprising a plurality of fabric layers. A foam pad is located between two of the layers of the upper. The pad extends down in front of the toe portion and underneath the front of the shank, and also wraps along the sides of the toe portion. The foam pad absorbs impact when the padded front end or padded bottom beneath the front of the shank of the ballet shoe are banged against the floor to reduce noise normally generated.

19 Claims, 2 Drawing Sheets

SOUND DEADENING BALLET SHOE

BACKGROUND OF THE INVENTION

The present invention relates to a ballet shoe having a sound deadening toe portion.

A ballet shoe or ballet slipper includes a shank extending beneath the wearer's sole. The shank includes a toe portion. The shoe includes a toe box above the toe portion of the shank which also covers the front part of the wearer's foot. The body of the ballet shoe, including its toe box, is defined by and is covered with a number of layers of flexible fabric material, including a silk or satin, or the like exterior layer, a cotton, or the like interior foot liner and intermediate fabric layers material, comprising generally from three to five layers.

A ballet shoe has a stiff, hard front. In some shoes, this is formed of appropriately shaped wood or stiff plastic. In other shoes, including preferably those disclosed here, the entire front portion is formed of layers of fabric, which are stiffened through having a sufficient number of fabric layers and through the use of glue layers between adjacent fabric layers.

Whether the front of the shoe is a covered over stiff unit or is a plurality of glued together fabric layers, the fabric covering material over the top of the front portion of the shoe and extending onto the bottom of the ballet shoe is wrapped around the front end of the shoe and is drawn down beneath the front end of the bottom surface of the shank. At the front end at the underside of the shank, the material layers are pleated and fastened to the underside of the shank. An outer sole is then placed over the bottom of the shank and over the periphery of the pleated material layers.

When a dancer moves, that is walks, runs, hops, jumps and bangs the foot that is wearing the ballet shoe, noise is generated by the front end of the toe portion and by the underside of the shoe shank forward of the outer sole banging against the floor.

It is presently known to eliminate noise generated by banging of the underside of the front portion of the shank, which is covered by the pleats, by placement of a pad of cushioning material above the pleats just at the bottom forward end of the shank. However, noise may still be generated by the front of the toe portion banging the floor and sometimes by the sides of the toe portion banging the floor.

SUMMARY OF THE INVENTION

It is the object of the present invention to reduce noise generated by the underside of the shank at the front of the toe portion, by the upstanding front end of the toe portion and by the sides of the toe portion banging the floor.

According to the invention, the noise generated by a ballet shoe is reduced by a pad, preferably of a foam material. The pad is shaped and sized to extend in front of the upright toe portion, on which the dancer occasionally stands and which the dancer frequently bangs on the floor. The pad is shaped to also wrap down over the front end of the underside of the shank. The pad may be slightly larger than the toe portion of the ballet shoe and when held in place may be slightly "cup" shaped. Generally, it covers the above indicated portions of the shoe and may cover slightly more of the shoe. The pleats in the covering fabric are formed over the pad which is unpleated.

The pad is placed between two of the plurality of layers of which the shoe upper is comprised. To reduce the bulk of the shoe upper at the pad and prevent formation of a ridge line at the periphery, one of the other layers of the upper is partially cut away.

Preferably, the material used for the pad is ethyl vinyl acetate. This is a fine cell, irradiation cross-linked, polyolefin, foam material. The pad is a quite thin layer, on the order of 1/32 of an inch thick. The pad cannot be made too thick because the dancer wants the feel of the floor, which the dancer cannot have if the front portion of the shoe is too cushioned. The invention is intended to reduce the noise produced by the shoe without diminishing the quality of the shoe production.

The inventor had experimented with other materials for the pad, such as cork material in a paste and other foams, but found the above material to be the best.

DETAILED DESCRIPTION OF THE PREFERRED EMBODIMENT

Figure 1:
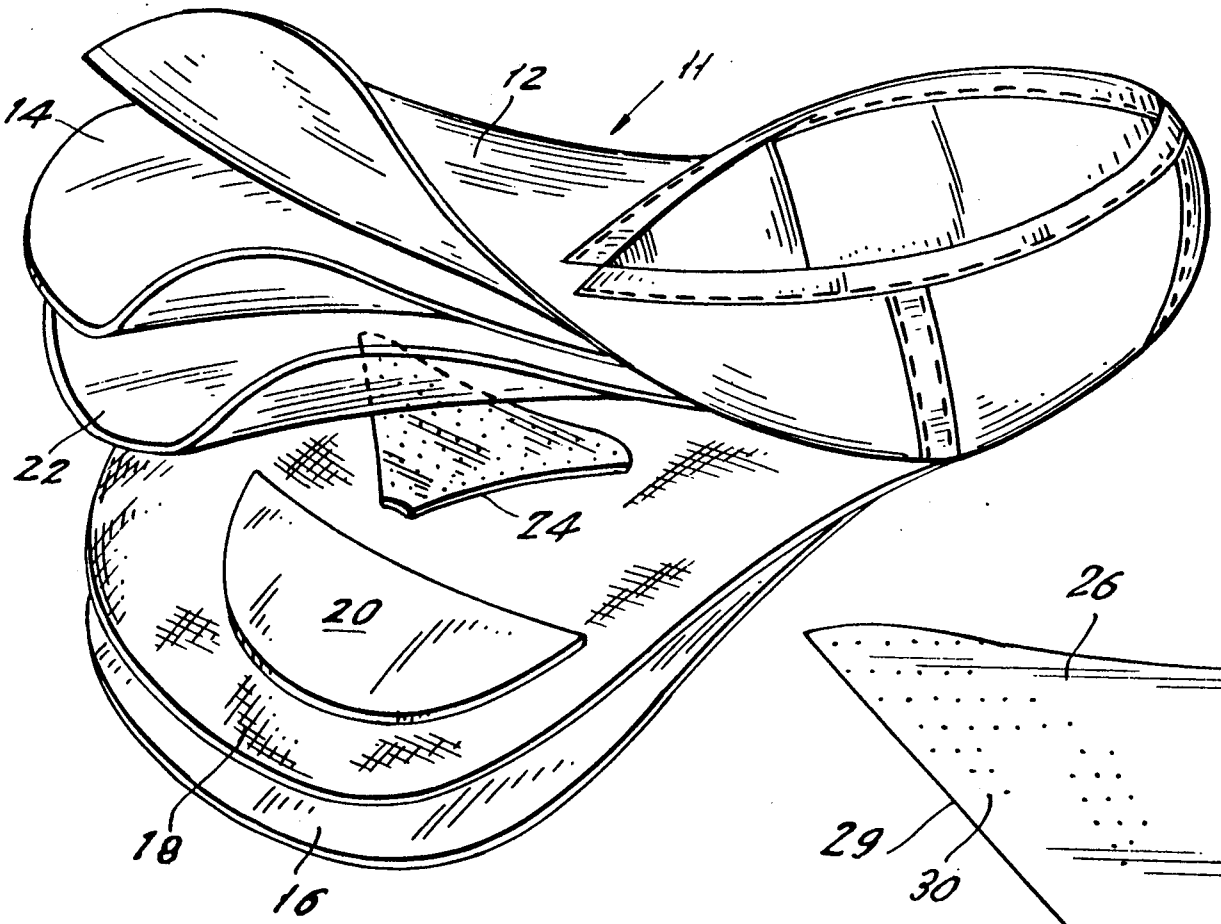
FIG. 1 illustrates a partially assembled upper of a ballet shoe, which includes a sound deadening foam pad at the toe portion according to the present invention.

The ballet shoe 10 according to the invention generally comprises a shoe upper portion 11 and a shoe shank 34. The upper 11 is comprised of three large area main fabric material layers. Each of the three layers 12, 14, and 16 is quite flexible. A decorative outer layer 12 of satin, or the like, overlies an intermediate layer 14 of a soft, non-decorative fabric such as cotton, which in turn overlies an inner foot contacting layer 16, which also is of a soft, non-decorative fabric such as cotton. The upper may be comprised only of these three layers or of more layers, or perhaps even of fewer layers.

The toe box region of the toe portion of the ballet shoe is more rigid than the rest of the shoe upper. With the decorative layer 12 and intermediate layer 14 shown pulled back as in FIG. 1, this exposes the top or exterior of the inner layer 16. A piece of flexible fabric 18, for example, a gauze-like material, with an external profile generally like that of the upper of the ballet slipper around the toe portion, is disposed over the layer 16 and is adhered at the toe box region of the shoe upper to the layer 16. A smaller pad 20 of felt, or the like, is then adhered to the layer 18 at the location where the tip or upstanding front end of the ballet shoe will eventually be defined and that piece of felt 20 is shaped to cover the tip of the ballet shoe and a little distance rearward from the tip. On top of the felt layer 20 and gauze layer 18, another gauze layer 22 having a profile generally similar to the layer 18 is adhered. The layers 18 and 22 therefore cover the toe portion of the ballet shoe and the smaller felt pad 20 covers the front tip and the area slightly rearward to the front tip of the shoe. All of the layers 12–22 are adhered to the adjacent layers by glue or adhesive applied between their facing surfaces. The thickness, number and placements of the layers and the adhesive between the layers when the adhesive sets determines the stiffness of the different regions of the shoe. The front portion of the shoe upper is quite stiff, rigid and strong enough to support a dancer standing on her toes and banging the toes on the floor. But this banging can generate unwanted noise.

A foam pad 24 for damping noise in accordance with the invention is located among the layers at the front portion of the upper, and is here placed between the felt pad 20 and the gauze layer 22. Alternately, the felt pad 20 may be made shorter in length toward the front of the shoe, and the gauze layer 22 may be made longer than usual in the shoe to provide an open region to accommodate the added bulk at the toe portion of the foam pad 24. The foam pad 24 is smaller in external profile than the felt pad 20. The pad 24 is shaped to cover the front end or tip of the toe portion and to also cover the front area of the underside of the shank forward of the outer sole over which the fabric layers are pleated. The pad 24 may extend a short distance laterally along the sides of the front portion of the shoe.

Figure 2:
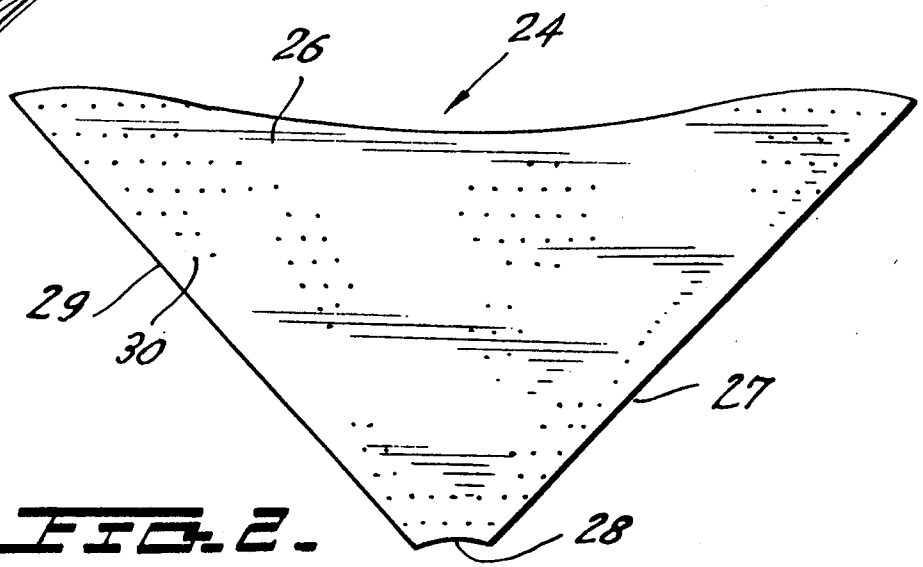
FIG. 2 is an elevational view of the foam pad shown in FIG. 1.
Figure 3:
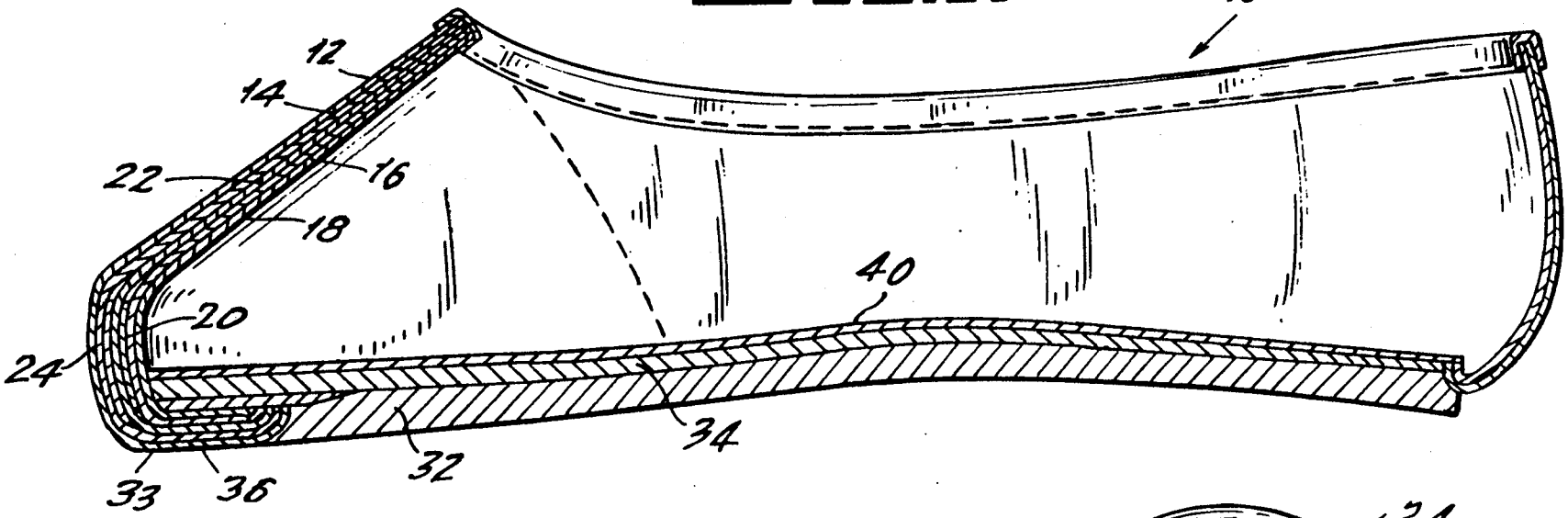
FIG. 3 is a longitudinal, cross-sectional view of the ballet shoe of FIG. 1.
Figure 5:
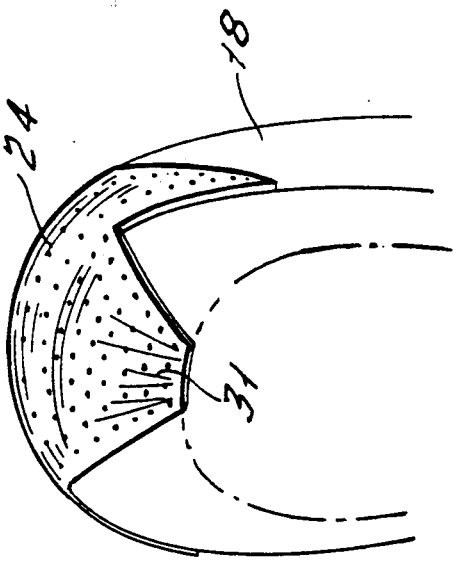
FIG. 5 is a cutaway view of the bottom of the toe portion of the ballet shoe according to the invention showing the bottom and side positioning of the foam pad on the ballet shoe.
Figure 4:
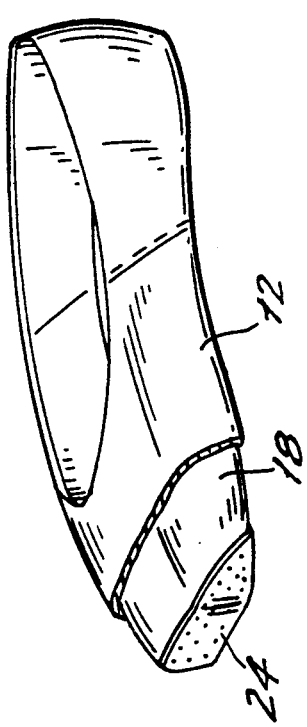
FIG. 4 is a perspective and partially cutaway view of the shoe of FIG. 1 wherein the foam pad is exposed.

The foam pad 24 may be generally triangular in shape. Alternately, it may be slightly "cup" shaped for a better fit to the toe portion, as can be seen in FIGS. 3-5. Referring to FIG. 2, the foam pad 24 is defined by a top 26 which is shaped in a curved, undulating manner. Sides 27 and 29 generally converge at a concave apex 28 located opposite top 26. The triangular profile enables the two other apices of the pad 24 to extend along the sides of the front portion. Other shapes for the foam pad 24 may be apparent to one skilled in the art so long as the pad covers the front end of the shoe, the underside of the shank at the front, and the sides of the front portion.

The foam pad 24 is preferably comprised of ethyl vinyl acetate. This material is a fine cell, irradiation cross-linked, polyolefin, foam, which has sufficient strength, but which also allows the material to breathe, as that is necessary during ballet shoe manufacturing to allow the glue or adhesive that has been applied between the various fabric layers to dry. The pad 24 includes numerous apertures 30 which may be arranged in horizontal rows. Apertures 30 further assist in allowing foam pad 24 to breathe. Other arrangements of the apertures 30 may be apparent to one skilled in the art. Foam pad 24 is quite thin, having a thickness on the order of 1/32 of an inch. The foam pad 24 should not h=too thick because the dancer wants the feel of the floor. If the front of the shoe is too cushioned, the dancer will not have the feel of the floor. In general, foam pad 24 should be thick enough to reduce the noise produced by the ballet shoe banging against the floor without diminishing the feel of the floor for the wearer.

An outer sole 32 is attached beneath the shank 34 and behind the pleated area 33 at which all of the layers 12, 14, 16, 18, and 22 in addition to foam pad 24 are attached in a pleated arrangement 36 of the fabric layers. But, the pad 24 remains unpleated. An inner sole 40, which contacts the wearer's foot, is adhered on top of the shank 34.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A ballet shoe for reducing noise occurring when a wearer bangs the shoe on a surface, comprising:

a shank for supporting the sole of the wearer's foot when the shoe is worn, the shank having a front end and having an underside;

an upper extending around the periphery of the shank and extending upward from the shank for surrounding part of the wearer's foot, the upper having a front portion which terminates at a front end and the front end of the upper being above the front end of the shank;

a thin triangularly shaped pad of noise reducing material having three sides which converge at three apexes, the pad being located in front of the front end of the upper and the triangular pad being oriented so that a first one of the apexes extends downward from the front end of the upper and under the underside of the shank at the front end of the shank for reducing the noise generated when the front end of the shoe upper or the underside of the shank at the front end thereof are banged against the surface; and each of the second and third apexes of the pad extends laterally along a respective side of the front portion of the shoe for also reducing noise occurring when one of the sides of the front portion is banged against the surface.

2. The ballet shoe of claim 1, wherein the pad is of a foam material.

3. The ballet shoe of claim 2, wherein the foam pad has a thin thickness for not substantially altering the overall thickness of the front portion of the shoe.

4. The ballet shoe of claim 2, wherein the foam pad is polyolefin foam.

5. The ballet shoe of claim 4, wherein the polyolefin foam is irradiation cross-linked.

6. The ballet shoe of claim 2, wherein said foam pad is a fine cell foam.

7. The ballet shoe of claim 2, wherein the upper is comprised of a plurality of layers of flexible material, including an external layer for providing an outer decorative appearance and an internal layer for providing inner, soft feel in the shoe for the wearer, the pad being disposed between the external and internal layers; the layers being adhered together to define and stiffen the front portion of the ballet shoe.

8. The ballet shoe of claim 7, wherein the foam pad has a plurality of apertures for allowing the foam pad to breathe when the foam layers are adhered during manufacture of the shoe.

9. The ballet shoe of claim 1, wherein the upper is comprised of a plurality of layers of flexible material, including an external layer for providing an outer decorative appearance and an internal layer for providing inner, soft feel in the shoe for the wearer, the pad being disposed between the external and internal layers; the layers being adhered together to define and stiffen the front portion of the ballet shoe.

10. The ballet shoe of claim 9, wherein the pad has a thin thickness for not substantially altering the overall thickness of the ballet shoe

11. The ballet shoe of claim 9, wherein the external layer comprises an outer satin layer for providing the decorative appearance, and the shoe having an intermediate layer of flexible material between the external and the internal layers.

12. The ballet shoe of claim 11, wherein the internal layer is of cotton for providing a soft feel for the wearer.

13. The ballet shoe of claim 11, further comprising additional layers located between the external and the internal layers and a felt pad located between the additional layers, the additional layers being shaped generally to the shape of the front portion of the shoe for defining the front portion and for providing more layers at the front portions for stiffening it and resulting in fewer layers of the upper rearward of the front portion, the noise damping pad also being in the front portion of the shoe.

14. The ballet shoe of claim 13, wherein the additional layers comprise two gauze layers generally having an external profile to that of the front portion, whereby the front portion with more layers may be stiffened.

15. The ballet shoe of claim 9, wherein the pad has a peripheral profile shape to extend laterally along the sides of the front portion of the shoe for also reducing noise occurring when the sides of the front portion are banged against the surface.

16. The ballet shoe of claim 15, wherein the foam pad has a thickness of about 1/32 of an inch.

17. The ballet shoe of claim 1, wherein the pad has a top that is defined by a curved, undulating shape.

18. The ballet shoe of claim 17, wherein the sides of the pad converge at a concave shaped apex.

19. The ballet shoe of claim 1, wherein the foam pad is generally cup shaped for fitting around the front portion of the shoe.

* * * * *